United States Patent [19]

Tison

[11] 3,952,923

[45] Apr. 27, 1976

[54] CANISTER TOOL

[76] Inventor: Thomas P. Tison, 3808 Reilly Lane, Shreveport, La. 71101

[22] Filed: June 30, 1975

[21] Appl. No.: 591,403

[52] U.S. Cl. ..... 222/174; 239/375

[51] Int. Cl.[2] ..... B67D 5/64; B05B 15/06

[58] Field of Search ..... 222/174, 191; 239/375, 239/532

[56] References Cited

UNITED STATES PATENTS

| | | | |
|---|---|---|---|
| 2,720,422 | 10/1955 | Mercur | 222/174 |
| 2,803,383 | 8/1957 | Dickman et al. | 239/375 X |
| 3,017,056 | 1/1962 | Bishop | 222/174 X |

*Primary Examiner*—Allen N. Knowles
*Attorney, Agent, or Firm*—John M. Harrison

[57] ABSTRACT

A tool designed to carry a spray canister and to enable spraying at a distance from and controlled by the user, which tool includes an arm adapted to removably receive a spray canister and means for activating the spray mechanism in the canister as desired by the user.

10 Claims, 4 Drawing Figures

FIG. 1
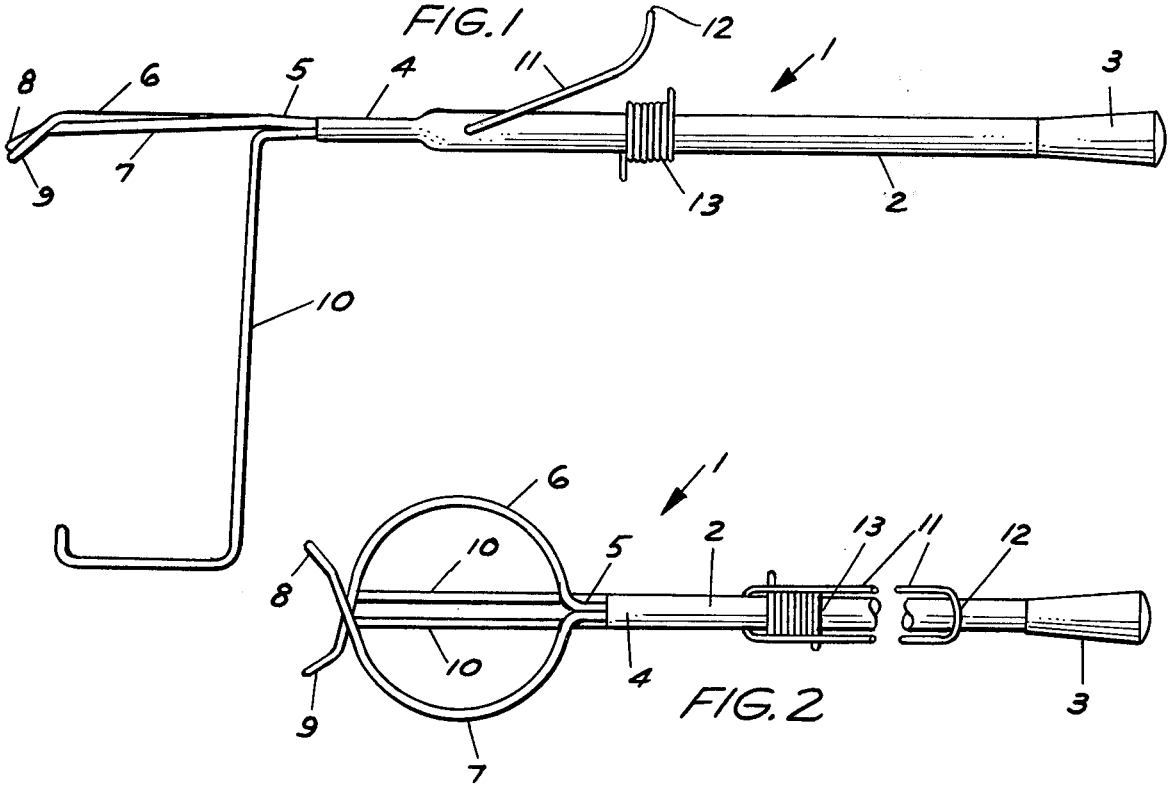
FIG. 2
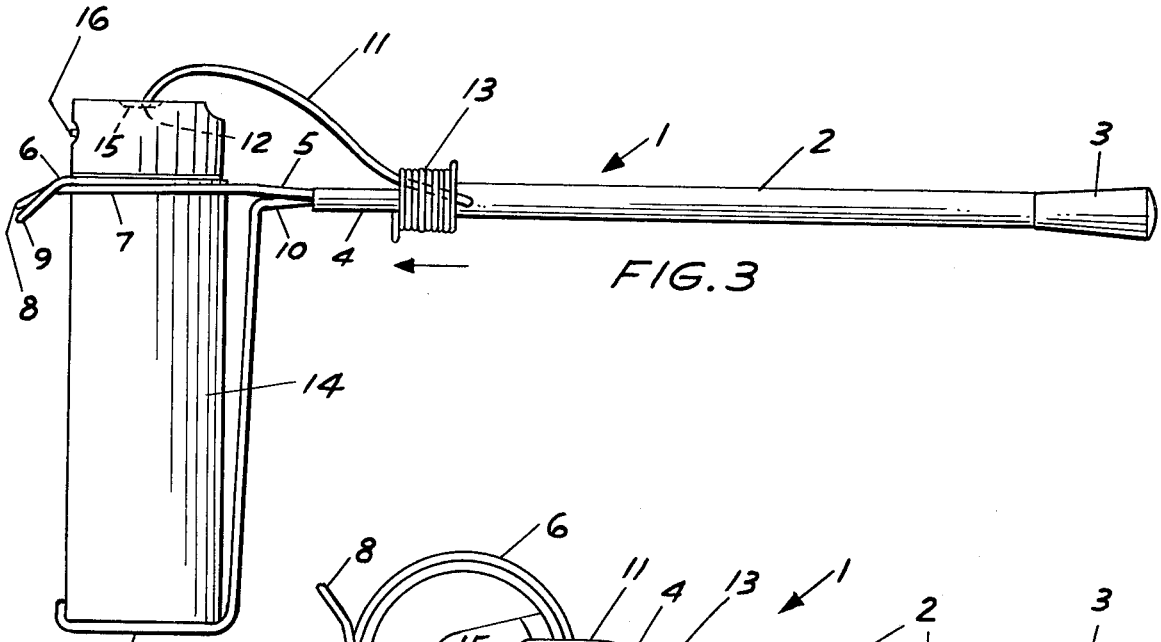
FIG. 3
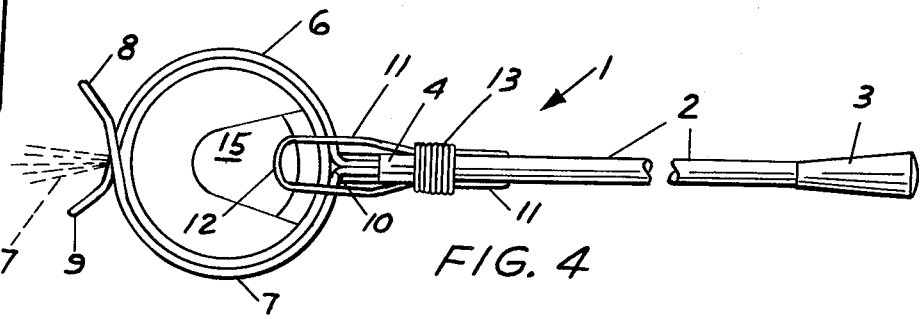
FIG. 4

CANISTER TOOL

BACKGROUND OF THE INVENTION

1. Field of the Invention

This invention relates to tools for use in cooperation with spray canisters, and particularly to tools extending the distance between the user and the spray canister being utilized. The instant invention is characterized by an extended arm, one end of which is adapted to receive a spray canister and a means for activating the spray mechanism of the canister, whereby the spraying operation can be achieved at a considerable distance from the user without the necessity of stooping or bending to effect spraying.

2. Description of the Prior Art

Heretofore, tools for carrying and operating spray containers at a distance from the user have chiefly taken the form of extension arms having a mechanism mounted at one end of the arm and adapted to removably receive a spray canister. Typical of such devices is the disclosure in U.S. Pat. No. 3,716,195, to George E. Silva, which discloses and claims a spray can holder mounted on an extension arm with a push button at the opposite end of the arm. The push button is in cooperation with a sliding member adapted to press against the spray can activator by application of thumb pressure on the button. Referring to the drawing of this patent, it is apparent that member 18, which is designed to engage spray mechanism 19 of the canister, is relatively wide and large, and accordingly, could not be operable to activate the spray mechanism of many modern spray canisters which have the spray actuator built into the cap of the canister. Furthermore, it is noted that memeber 13, from which projections 14 and 15, which hold the canister in place protrude, does not bend around the bottom of the spray canister. Accordingly, pressure brought to bear by member 18 on the canister actuator 19 of a typical canister might well cause the canister to be disposed in a downward position instead of activating the spray mechanism as desired.

Furthermore, since spray canisters are manufactured in a wide variety of sizes, the design of retaining members 14 and 15 would indicate that some canisters might be either too small or too large for these members, and therefore might not fit the spray mechanism illustrated.

Accordingly, it is an object of this invention to provide a canister tool which is designed to receive a pressurized spray canister and achieve spraying at an extended distance from a user.

Another object of this invention is to provide a canister tool equipped with a positive, secure spray activating mechanism which can be simply and easily manipulated.

Still another object of the invention is to provide a canister tool which can be adapted to releasably secure and activate substantially any pressurized aerosol spray canister, regardless of size or design.

Yet another object of the invention is to provide a tool for releasably securing and activating pressurized aerosol spray canisters which utilizes a simple slide keeper and cooperating pivoted spray activator to initiate and stop the spraying operation.

A still further object of this invention is to provide a canister tool adapted to releasably receive a pressurized spray canister by means of a clamp and canister supports and equipped with a pivoted spray activator designed to engage the canister spray actuator, and in cooperation with a slide keeper, to activate the canister actuator to initiate spraying.

Another object of the invention is to provide a canister tool designed to releasably and removably receive aerosol spray canisters of essentially all sizes and containing bug and insect insecticide, as well as mosquito repellent, paint, and other useful aerosol preparations.

SUMMARY OF THE INVENTION

These and other embodiments of the invention are provided in a canister tool having the following elements:

1. An arm, one end of which is equipped with a pad and the other with at least one canister support;
2. A clamp consisting of a pair of clamp arms, each having clamp arm tips on the ends thereof, respectively;
3. A spray activator placed in pivoting, movable cooperation with the arm; and
4. A slide keeper slidably disposed on the arm and adapted to cooperate with the spray activator and exert sufficient force on the spray activator to effect activation of the canister actuator.

BRIEF DESCRIPTION OF THE DRAWINGS

The invention will be better understood in view of the following description presented with reference to the accompanying drawings.

FIG. 1 of the drawings is a left side elevation of the canister tool of this invention;

FIG. 2 is a top view of the canister tool illustrated in FIG. 1;

FIG. 3 is a left side elevation of the canister tool illustrated in FIGS. 1 and 2 with a canister in operable position in the canister tool; and FIG. 4 is a top view of the canister tool illustrated in FIG. 3 illustrating operation of the tool.

DESCRIPTION OF THE PREFERRED EMBODIMENTS

Referring now to FIGS. 1 and 2 of the drawing, the canister tool of this invention, generally illustrated by reference numeral 1, is illustrated with arm 2 carrying pad 3 at one end thereof, and flattened at the other end to form neck 4. Arm 2 is preferably hollow, and clamp 5, along with canister supports 10, is fitted into the interior of neck 4. Clamp 5 is formed of first clamp arm 6 and second clamp arm 7, first clamp arm 6 being bent to form first clamp arm tip 9 at the extreme end thereof, and second clamp arm 7 being likewise bent at the end to form second clamp arm tip 8. Canister supports 10 are disposed initially in a downwardly direction and are subsequently bent essentially parallel to arm 2 and back in an upward direction, as illustrated. Spray activator 11 is pivotally connected to arm 2 immediately adjacent neck 4, and slide keeper 13 is designed to fit loosely on arm 2 to permit sliding up and down the full length of arm 2 and onto spray actuator 11, as hereinafter described. The diameter of pad 3 is sufficiently large to prevent slide keeper 13 from falling off of arm 2.

Referring now to FIGS. 3 and 4 of the drawing, a spray canister 14 is illustrated in functional position on canister supports 10, securely maintained in contact with canister supports 10 by means of first clamp arm 6 and second clamp arm 7. Spray canister 14 is initially fitted into position by first sliding slide keeper 13 rearwardly away from spray activator 11, pivoting spray activator 11 toward pad 3 (as illustrated in FIG. 2), and exerting pressure on first clamp arm tip 9 and second clamp arm tip 8 with the fingers, thereby spreading first clamp arm 6 and second clamp arm 7 to permit the canister to be placed securely in contact with canister supports 10, as illustrated. Releasing pressure on first clamp arm tip 9 and second clamp arm tip 8 allows the spring tension in first clamp arm 6 and second clamp arm 7 to be exerted against the canister, thereby securely holding it in place. As illustrated, canister 14 is positioned to direct spray nozzle 16 forward of canister 21 and in a direction essentially parallel with arm 2. After canister 14 is secured in the proper position, spray activator 11 can be pivoted on arm 2 to a position as illustrated in FIGS. 3 and 4, with spray activator tip 12 in contact with canister actuator 15, built into the top portion of canister 14. Slide keeper 13 may then be moved toward canister 14 on arm 2 in the direction of the arrow until it engages spray activator 11, as illustrated in FIG. 3 of the drawing.

Referring now particularly to FIG. 4 of the drawing, when it is desired to initiate spraying, slide keeper 13 is forced forward toward canister 14 against the bias of spray activator 11 to effect a depression of canister actuator 15, due to pressure exerted by spray activator tip 12, to cause spray 17 to emit from spray nozzle 16. Canister 14 can then be manipulated as desired by the user by means of arm 2, and the spraying operation may be terminated by moving slide keeper 13 away from canister 14 and off of spray activator 11, thereby releasing pressure from canister actuator 15 and terminating the spray. Spray activator 11 is preferably formed of a wire having a high carbon content such as a high grade of music wire, in order to provide sufficient bias to depress canister actuator 15 when engaged by slide keeper 13.

A chief advantage of the canister tool of this invention is providing good wetting of the area to be treated or sprayed while allowing the user to stand or sit during the application. Extension of canister 14 from the user by means of arm 2 also removes the user from the spray area thereby preventing inhalation of toxic spray fumes.

It will be appreciated that arm 3 can be provided in substantially any desired length and can be manufactured of substantially any material such as wood, metal, plastic or fiberglass. The tool is also characterized by simplicity of use since it needs no wire, string or other "pull" mechanism for operation. A simple moving of slide keeper 13 forward onto spray activator 11 initiates the spray, and sliding the slide keeper 13 away from spray activator 11 stops the spraying operation.

It will be appreciated that canister tool 1 can be easily provided with a clamp 5 and canister supports 10 to fit essentially any spray container presently on the market. Paint aerosol canisters, bug and roach spray canisters and the like can be utilized in a canister tool fitted with a clamp and canister supports of appropriate size. Furthermore, both the clamp 5 and the canister supports 10 can be removably fitted to neck 4 of arm 2, thereby providing a common arm which can accommodate canisters of varying size by changing the clamp and canister support members.

The canister tool of this invention is simple and easy to use and does not require use of any tools for assembly or utilization. Furthermore, the tool requires no adjustment or addition of other elements to be functional.

Having described my invention with the particularity set forth above, what is claimed is:

1. A canister tool comprising:

a. an arm of selected length;

b. at least one canister support attached to one end of said arm and disposed forward of and beneath said one end of said arm to receive a canister;

c. clamp means attached to the same end of said arm as said canister support to engage and secure a canister placed in said canister support;

d. a spray activator in pivotal cooperation with said arm and adapted to releasably engage the canister actuator of a canister; and e. a slide keeper concentrically and slidably cooperating with said arm and said spray activator, whereby when a canister is fitted into said canister tool in cooperation with said canister support and said clamp means, and said spray activator is positioned to pivotally engage said canister actuator, and said slide keeper is positioned so as to slidably engage said spray activator to bias said spray activator downwardly against said canister actuator, spray emits from said canister.

2. The canister tool of claim 1 wherein said at least one canister support is a pair of canister supports.

3. The canister of claim 1 wherein said clamp means is a first clamp arm and a cooperating second clamp arm, which first clamp arm and second clamp arm essentially describe a circle forward of said arm, to removably receive a canister.

4. The canister tool of claim 1 wherein:

a. said at least one canister support is a pair of canister supports; and b. said clamp means is a first clamp arm and a cooperating second clamp arm, which first clamp arm and second clamp arm essentially describe a circle forward of said arm, to removably receive a canister.

5. The canister tool of claim 1 wherein one end of said first clamp arm is shaped to form a first clamp arm tip and one end of said second clamp arm is shaped to form a second clamp arm tip.

6. The canister tool of claim 1 wherein:

a. said at least one canister support is a pair of canister supports;

b. said clamp means is a first clamp arm and a cooperating second clamp arm, which first clamp arm and second clamp arm essentially describe a circle forward of said arm, to removably receive a canister; and c. one end of said first clamp arm is shaped to form a first clamp arm tip and one end of said second clamp arm is shaped to form a second clamp arm tip.

7. The canister tool of claim 1 wherein said one end of said arm is flattened into a neck to receive said at least one canister support and said clamp means.

8. The canister tool of claim 1 further comprising a pad disposed on the end of said arm opposite said canister support and said clamp means.

9. The canister tool of claim 1 wherein said spray activator is formed of substantially stiff, music wire.

10. The canister tool of claim 1 wherein:

a. said at least one canister support is a pair of canister supports;

b. said clamp means is a first clamp arm and a cooperating second clamp arm, which first clamp arm and second clamp arm essentially describe a circle forward of said arm, to removably receive a canister;

c. one end of said first clamp arm is shaped to form a first clamp arm tip and one end of said second clamp arm is shaped to form a second clamp arm tip;

d. said spray activator is formed of substantially stiff, music wire; and e. further comprising a pad disposed on the end of said arm opposite said canister support and said clamp means.

* * * * *